US005688295A

United States Patent [19]

Yang

[11] Patent Number: 5,688,295

[45] Date of Patent: Nov. 18, 1997

[54] GASOLINE FUEL ADDITIVE

[75] Inventor: Chung-Hsien Yang, Hsintien, Taiwan

[73] Assignee: H. E. W. D. Enterprises-America, Inc., St. Louis, Mo.

[21] Appl. No.: 646,659

[22] Filed: May 8, 1996

[51] Int. Cl.[6] ..... C10L 1/18; C10L 1/28

[52] U.S. Cl. ..... 44/320; 44/438; 44/439; 123/1 A

[58] Field of Search ..... 44/320, 438, 439; 123/1 A

[56] References Cited

U.S. PATENT DOCUMENTS

| | | | |
|---|---|---|---|
| 1,474,983 | 11/1923 | Schreiber | 44/438 |
| 2,407,718 | 9/1946 | Marschner et al. | 44/439 |
| 2,529,496 | 11/1950 | Hughes et al. | 44/138 |
| 2,701,754 | 2/1955 | Haworth et al. | 44/439 |
| 2,864,675 | 12/1958 | Jean | 44/438 |
| 3,713,793 | 1/1973 | Maruyama et al. . | |
| 3,902,868 | 9/1975 | Zach, Jr. | 44/438 |
| 3,976,438 | 8/1976 | Bay . | |
| 4,131,434 | 12/1978 | Gonzalez . | |
| 4,149,853 | 4/1979 | DesMarais, Jr. et al. . | |
| 4,265,638 | 5/1981 | Burke | 44/438 |
| 4,332,594 | 6/1982 | Zimmerman | 44/320 |
| 4,372,753 | 2/1983 | Narasimhan, Jr. et al. . | |
| 4,405,336 | 9/1983 | Badger | 44/438 |
| 4,595,784 | 6/1986 | Mendenhall et al. | 44/439 |
| 4,743,272 | 5/1988 | Weinberger | 44/438 |
| 4,812,146 | 3/1989 | Jessup . | |
| 5,004,850 | 4/1991 | Wilson . | |
| 5,055,562 | 10/1991 | Neidiffer et al. . | |
| 5,093,533 | 3/1992 | Wilson . | |
| 5,141,524 | 8/1992 | Gonzalez . | |
| 5,208,402 | 5/1993 | Wilson . | |

*Primary Examiner*—Margaret Medley
*Attorney, Agent, or Firm*—Paul M. Denk

[57] ABSTRACT

A compound for use as an additive to gasoline or as a fuel is provided. The compound has the molecular formula:

is provided where R is $CH_3$, $C_3H_6$, $C_7H_8$, $C_6H_{10}$, or $C_{10}H_{18}$; $R_1$ is a carbonyl group (C=O), $R_2$ is H or —OH (hydroxyl), and $R_3$ is an aliphatic compound or a silicon compound. The product is formed through pressure reaction to generate energy chain and change the original molecular structure to form a closed chain. Due to the reaction mechanism, a mixture is provided which is approximately 40~70% alcohol, approximately 2.5~18% ketone and ethers, and approximately 4~20% aliphatic and silicon compounds. It has 2 to 10 carbon atoms and 3 to 18 hydrogen and 3 to 16 oxygen atoms. The mixture is added to gasoline to provide a fuel mixture. The fuel mixture contains up to 70% by volume of the additive mixture. When added to gasoline, the compound of the invention increases motor power and reduces pollutants put out by the motor.

10 Claims, 4 Drawing Sheets

NOx, CO AND HC CONCENTRATION OF DISCHARGE OF A14 INJECTION ENGINE USING 95 UNLEADED GASOLINE WITH ADDITIVE K AT 800 RPM

NOx, CO AND HC CONCENTRATION OF DISCHARGE OF A14 INJECTION ENGINE USING 95 UNLEADED GASOLINE WITH ADDITIVE K AT 1500 RPM

NOx, CO AND HC CONCENTRATION OF DISCHARGE OF A14 INJECTION ENGINE USING 95 UNLEADED GASOLINE WITH ADDITIVE K AT 2200 RPM

GASOLINE FUEL ADDITIVE

BACKGROUND OF THE INVENTION

This invention relates to fuel mixtures and, in particular, to a mixture which can be added to gasoline to form a fuel mixture which will enhance motor power and reduce pollutants produced by the motor.

Since World War II, the petrochemical industry has grown rapidly as the use of cars and other gasoline powered vehicles has grown. Gasoline, as a main source of fuel for personal vehicles, is one of the most important resources in the world. However, gasoline is being used excessively and the supply of gasoline is dwindling. Some believe that the supply will not last much longer.

As a result of the prosperity of the auto industry and the high use of the gasoline, air pollution is generated. The pollution generated by gasoline powered vehicles has contributed to the ruination of our living environment, endangered the health of mankind, and most seriously, it has contributed to the depletion of the ozone layer, and the greenhouse effect. The development of a new energy source or an energy replacement which will reduce pollution output has thus become an important research topic.

Methanol is acknowledged to be the only substance to be mixed with gasoline. Methanol/gasoline mixtures have been found to reduce air pollution and to be cost effective. Methanol is even a possible replacement for the gasoline.

Prior to the use of methanol, ethanol was tried as a gasoline additive. In 1970, the United States tried to mix 10% vol. of ethanol with gasoline to reduce the pollution. The 10% ethanol mixture reduced pollution by only 10%. However, ethanol is four times more expensive than gasoline. Thus, the use of ethanol to reduce pollution was thus not economically beneficial. Between 1973 and 1976, the United States conducted experiments on the use methanol as an additive to gasoline. Methanol was added at 5% to 15% vol. Methanol was found to have better benefit in the fuel consumption and economy. It is better than pure gasoline.

As a conclusion of the research reports, methanol and ethanol have been listed as the two primary energy replacements. Israel, for example, has ordered the addition of 3% vol. of methanol in gasoline, Norway has ordered the addition of 4% vol. methanol, and Brazil has ordered the addition of 13–15% of ethanol in the gasoline. The buses in California are also required to use methanol in its gasoline.

Although the use of methanol has been found to reduce pollution output, it cannot be added to a standard engine. The engine must be modified to accept methanol containing fuels. Further, the methanol content of the fuel cannot exceed 15%. The present goal of the research is to use the 15% vol. methanol in the gasoline without modifying the engine, to improve its economic result, and to reduce the pollution. However, there has been no breakthrough yet. There are still many difficulties that have been encountered which have yet to be overcome.

A laboratory report of AMOCO Petroleum Company has pointed out that the first two difficulties encountered in the use of methanol are the "phase separation" and "emulsification". The F.F.V.S. project of Ford Motor Company has also found that the engine must be modified to accept methanol containing fuels. Many research reports have clearly pointed out that with methanol content of 8%–12%, the fuel mixture must be supplemented with compounds such as methyl-tert-butyl ethane (MTBE), ethyl-tert-butyl ethane (ETBE), iso-butyl alcohol (IBA), tert-butyl alcohol (TBA), iso-octane, and N-butanol, all of which are expensive. Even so, when experimenting with 15% vol. of methanol, the output of the engine has been found to decrease by 10% from the normal output. The torque has also been found to decreased by 8%.

This invention has not only surmounted the difficulties which were pointed out in the research reports of all nations, it has even merged a high volume of methanol, 30% vol., in the gasoline to reach a high efficacy of air pollution reduction, and has even effectively saved energy and brought economic result.

SUMMARY OF THE INVENTION

An object of this invention is to provide a compound or mixture of compounds which can be added to, or combined with, gasoline, to produce a fuel mixture which will increase the power output of gasoline motors and which will reduce the pollution output by the motors.

Another object is to provide such a fuel mixture which can be used by standard gasoline engines without the need to modify the engines.

These and other objects will be apparent to those skilled in the art upon a review of the following disclosure and accompanying drawings.

In accordance with the invention, generally stated, an alcohol based fuel additive is provided which may be added to gasoline for use in improving the performance of gasoline powered internal combustion engines without the need to modify standard gasoline engines. The additive is added to gasoline to form a fuel composition, which is 15%–70% by volume additive and 30%–85% gasoline. The fuel additive comprises about 20%–70% alcohol, about 2.5%–20% ketone and ether, about 0.03%–20% aliphatic and silicon compounds, about 5%–20% toluene, and about 4%–45% mineral spirits. The alcohol is methanol and ethanol, the methanol comprising about 20%–70% of the additive and the ethanol comprises about 0.05–0.35% of the additive. The ketone is acetone, butanone, cyclohexanone, or combinations thereof. The aliphatic compound is mineral spirits, dihydric alcohol, or tribasic alcohol. The silicon compound is $(—Si—O—)_n$, where n is equal to or greater than 4. The silicon compound comprises about 0.003%–1% of the additive. The fuel additive has the basic formula:

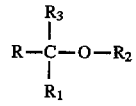

where R is $CH_3$, $C_3H_6$, $C_7H_8$, $C_6H_{10}$, or $C_{10}H_{18}$; $R_1$ is a carbonyl group, $R_2$ is H or —OH, and $R_3$ is an aliphatic compound or a silicon compound, and wherein the compound has 2–10 carbon atoms, 3–18 hydrogen atoms, and 3–16 oxygen atoms.

DESCRIPTION OF THE PREFERRED EMBODIMENT

Figure 1B:
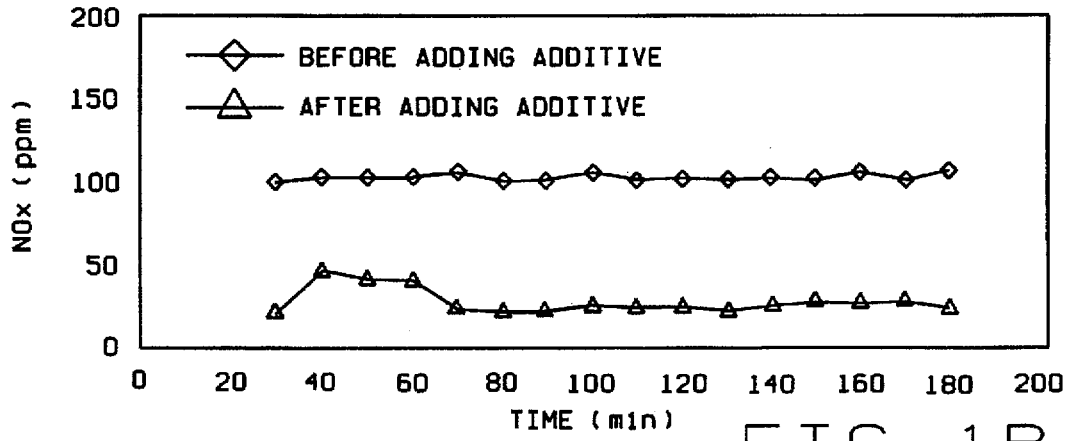
FIG. 1, 1A, 1B is a series of three graphs showing the results of $NO_x$, CO, and HC emissions of an A14 injection engine using 95# unleaded gasoline with the additive at 800 rpm.
Figure 1A:
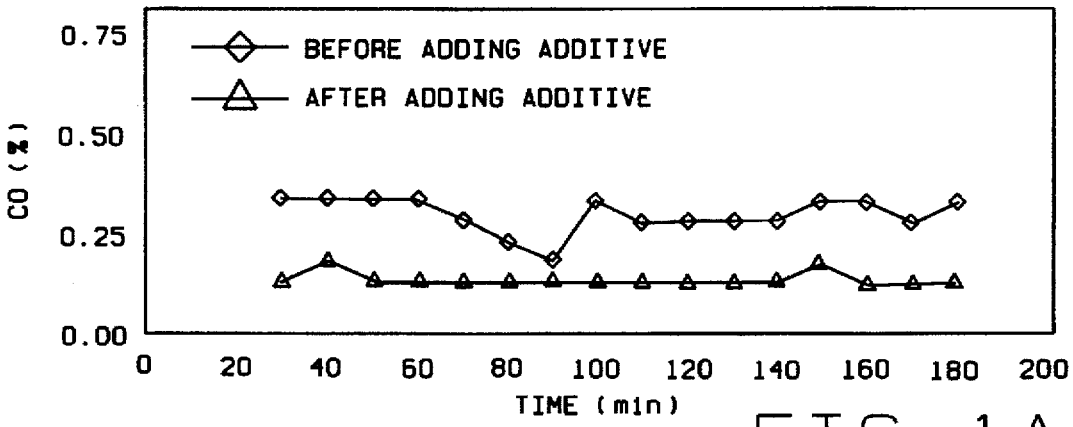

The compound of this invention has several special functions. It is suitable for any type of internal combustion engine fueled with gasoline, such as the traditional carburetor, fuel injection, low or high compression ratio engines. In addition, no modification is needed to the original design of the engine to use the compound of the invention. This compound is a type of additive and is not intended to be used alone. Rather, it should be mixed with gasoline in proportion to the various ratios set out below. Use of the compound has been found to not only improve the quality of the gasoline, but also to enhance the engine horse power, save energy and further reduce the air pollution generated by the car. This invention has a very positive and outstanding effect on the energy saving and air pollution improvement.

The compound has the molecular formula:

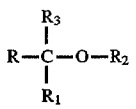

where R is $CH_3$, $C_3H_6$, $C_7H_8$, $C_6H_{10}$, or $C_{10}H_{18}$; $R_1$ is a carbonyl group (C═O), $R_2$ is H or —OH (hydroxyl), and $R_3$ is an aliphatic or a silicon compound. The aliphatic compounds are $C_2H_4(OH)_2$ or $C_3H_5(OH)_3$, and the silicon commands are $C_8H_{20}O_4Si$ or $(C_2H_5)_2SiO_3$. The product is formed through pressure reaction to generate energy and change the original molecular structure to form a closed chain. Due to the reaction mechanism, a mixture is provided which is approximately 40–70% alcohol, 2.5–18% ketone and ethers, and 4–20% aliphatic compounds. The molecule has 2 to 10 carbon atoms, 3 to 18 hydrogen atoms, and 3 to 16 oxygen atoms. Analysis of the resultant mixtures shows that the additive mixture may form in three possible combinations as follows, the percentages being by volume:

Combination 1

A. Alcohol
  1. Methanol 40%–70%
  2. Ethanol 0.05%–0.35%

B. Ketone and ether 2.5%–18%
C. Aliphatic and silicon compounds 0.03%–20%
D. Toluene 5%–13%
E. Mineral spirits 4%–10%

This composition or combination is added to gasoline in the range of between 15%–30% by volume of the fuel in the engine. (i.e., the fuel is 15%–30% additive and 70%–85% gasoline). In this composition, the ketone may be 14%–16%, the ether may be 0.8%–2%, the aliphatic compound may be 8%–15%, and the silicon compound may be 0.03%–0.05%. In this composition, the ketone may be $CH_3.CO.CH_3$ or $CH_3.CO.C_2H_5$, the ether may be $C_4H_{10}O$, the aliphatic compound may be $C_2H_4(OH)_2$ or $C_3H_5(OH)_3$, and the silicon compound may be $C_8H_{20}O_4Si$ or $(C_2H_5)_2SiO_3$.

Combination 2

A. Alcohol
  1. Methanol 25%–50%
  2. Ethanol 0.05%–0.35%

B. Ketone and ether 4%–20%
C. Aliphatic and silicon compounds 0.03%–20%
D. Toluene 8%–18%
E. Mineral spirits 10%–20%

This composition or combination is added to gasoline in the range of between 40%–50% by volume of the fuel in the engine. (i.e., the fuel is 40%–50% additive and 50%–60% gasoline). In this composition, the ketone may be 18%–20% of the additive, the ether may be 2–4% of the additive, the aliphatic compound may be 12–18% of the additive, and the silicon compound may be 0.05–0.07% of the additive. In this composition, the ketone may be $CH_3.CO.CH_3$ OR $C_2H_5CO.C_3H_7$, the ether may be $C_4H_{10}O$, the aliphatic compound may be $C_2H_4(OH)_2$ or $C_3H_5(OH)_3$, and the silicon compound may be $C_8H_{20}O_4Si$ or $(C_2H_5)_2SiO_3$.

Combination 3

A. Alcohol
  1. Methanol 20%–45%
  2. Ethanol 0.05%–0.50%

B. Ketone and ether 2.5%–20%
C. Aliphatic and silicon compounds 0.03%–20%
D. Toluene 10%–20%
E. Mineral spirits 20%–45%

This composition or combination is added to gasoline in the range of between 50%–70% by volume of the fuel in the engine. (i.e., the fuel is 50%–70% additive and 30%–50% gasoline). In this composition, the ketone may be 20–25% of the additive, the ether may be 5–8% of the additive, the aliphatic compound may be 20–35% of the additive, and the silicon compound may be 0.5–1% of the additive. In this composition, the ketone may be $CH_3.CO.CH_3$ OR $C_2H_5.CO.C_3H_7$, the ether may be $C_4H_{10}O$, the aliphatic compound may be $C_2H_4(OH)_2$ or $C_3H_5(OH)_3$, and the silicon compound may be $C_8H_{20}O_4Si$ or $(C_2H_5)_2SiO_3$.

Alcohol is a polar substance and gasoline is a non-polar substance. When mixing the two substances, "phase separation" and "emulsification" will occur. The atom chains formed a cyclic structure, which is a "closed chain", is the best and most suitable structure for gasoline. A benzol chain is a good example of the cyclic structure which is suitable as an additive for gasoline.

The primary characteristic of carbon is that it forms bonds easily with other carbon atoms and can form numerous kinds of organic compounds. The primary movement of the carbon atom is mainly based on its four valences. To form a non-polar compound, this the carbon atom must have a weak positive or weak negative charge. The characteristics of carbon-xides (CxXy) are as follows:

1. Non-polarity
2. Polymerism. That is, similar molecules will conjoin with each other to form a bigger or a more complex molecule.
3. Combustibility. When heating up, all carbon atoms can be oxidized to form another reactant.

These three characteristics are suitable for mixing with non-polar gasoline. On the other hand, the reaction of oxygen is very strong. Oxygen can be compounded with other elements outside of the O family. These conditions can form a cyclic compounds such as the following chemical structures:

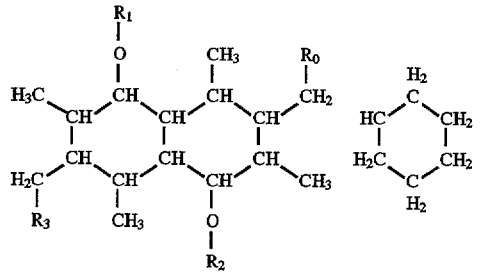

This invention has successfully changed the molecular structure of the alcohol to a non-polar substance. Therefore, it can be merged completely with gasoline, and the "phase separation" and "emulsification" will not occur.

The fuel additive or fuel mixture of the present invention has several special functions.

1) It may be used with any type of internal combustion engine which uses gasoline as fuel, such as the traditional carburetor, fuel injection, low or high compression ratio, including the two-stroke motorcycle. In addition, the motor does not need to be modified to use the fuel additive or fuel mixture.
2) This invention is an additive. It cannot be used alone. It must be mixed with at least some gasoline. The amount of additive is between 15 to 30%. When the additive is added to the gasoline in excess of 30% (i.e., up to 70%) it becomes more than an additive and becomes part of the fuel. The mixture of the gasoline and the additive thus form a "fuel mixture".
3) The additive can improve the quality of the fuel. It (a) improves the octane value of the gasoline; (b) reduces the Reid vapor pressure and eliminates "vapor lock"; (c) reduces the sulfur content of the pollutants output by the motor; (d) reduces the existing gum in the gasoline; (e) reduces the benzene content of the fuel; and (f) replaces MTBE (methyl tert-butyl ethane), which is needed when methanol is used as a gasoline additive.
4) The additive can improve the horse power output by about 3% to about 4.2%.
5) Gasoline is now an indispensable energy in the world. The additive can replace up to 70% by volume of gasoline used in gasoline powered engines.
6) The additive noticeably reduces air pollution output by the engine. Using my additive without using any catalyst, the CO level output by an engine is reduced by about 49% to about 80%; the hydrocarbon level output is reduced by about 9.5% to 16.26%; the $NO_x$ level output is reduced by about 24.4%, and $CO_2$ level output is reduced by about 11.7%.
7) The additive can reduce gasoline consumption by 10–20% (i.e., it improves fuel economy).
8) When the additive is mixed with gasoline to make up about 15%–40% by volume of the motor fuel, I consider it to be an additive. When the additive is mixed with gasoline to make up about 40% to about 70% of the volume of the motor fuel, the additive becomes more of a fuel, and the additive-gasoline mixture produces a new fuel mixture.
9) The primary composition of this invention is alcohol, including methanol, ethanol, hexyl alcohol, glycerin, ethanediol, etc. Methanol is used most often, from 40% to 70%.
10) Methanol and ethanol are both polar substances. When mixed with gasoline, their volume should not exceed 5%. Once this limit is exceeded, a "phase separation" and "emulsification" reaction will occur. This invention can change the polarity of the alcohol to eliminate this phase separation and emulsification. This allows for increased use of methanol.
11) Gasoline includes aromatic compounds. The composition of my additive is mainly aliphatic compounds. The aliphatic compounds replace the aromatic compounds in order to change the quality of the gasoline.
12) This invention can absorb large quantity of heat, and reduce the engine temperature. When the water tank (pipe) breaks or leaks, and the fan belt breaks, the car can still drive for up to thirty minutes without damaging the engine.
13) This invention can eliminate the carbon accumulation in the engine to avoid pollution in the motor oil. Since this, invention can reduce the engine temperature, the motor oil will not degenerate due to high temperature. Therefore, it can maintain a good lubricant function. The mileage of the motor oil can also be used for about 15,000 km (about 9300 miles) before needing to be changed which is three times the norm (automobile motor oil regularly is changed every 5,000 km (about 3100 miles)). This is also part of the energy saving process in that the oil is changed less often, and therefore less oil is used over the life of the car.
14) This invention can restrain the generation of aldehydes.
15) This invention can clean the gas supply system and oil injection opening.
16) This invention does not contain lead, manganese, cadmium, copper, nickel, zinc, iron, phosphorus, etc.

As noted above, alcohol, and in particular methanol, forms a large part of the additive. Methanol has many advantages. (1) The octane value of methanol is as high as 106. Its anti-knocking qualities are extremely good. (2) Methanol has high latent heat of evaporation. It can absorb a large amount of heat during the adiabatic expansion process in the engine. It has good cooling effect. The exothermic reaction of methanol is greater than the gasoline. It has greater horse power output. (3) Methanol is a clean fuel which does not contain any lead or sulfur. It will not cause gum accumulation in the fuel system. (4) The pollutant emission of methanol is far less than that of gasoline. Its carbon monoxide and hydrocarbon content is about 30% that of the gasoline. Its nitrogen oxide content is about 70% that of the gasoline. Hence, the carbon smoke in the waste gas is 50% less than that of the gasoline.

The qualities of methanol surpass the quality of the gasoline. Therefore, mixing methanol with gasoline is considered to be the most economical fuel to replace gasoline. Theoretically, methanol has a high heat of evaporation (506 BTU/LB) whereas the heat of evaporation of gasoline is 150 BTU/LB. The use of methanol also should produce a higher horse power output than that of gasoline. However, when it is actually used as auto fuel, its effect is the opposite. Theoretically, the air-fuel ratio of methanol is less than one half of gasoline. That is, under the same air-fuel ratio, the oil consumption of methanol is twice that of gasoline. The evaporation heat of methanol is 279.66 Cal/gm, and of gasoline is 73.39 Cal/gm. If it is actually applied to the cars, the gas tank will have to be expanded to twice the original size. The outlet of the gas supply system and carburetor will have to be expanded also in order to increase the gas supply volume. The Reid Vapor pressure of methanol is far higher than that of gasoline. Vapor lock will thus occur more readily. Its heat value is far less than that of gasoline (The heat value of methanol is 4800 Cal/gm, and the heat value of gasoline is 10,500 Cal/gm). Under normal operation, when the gasoline enters the cylinder, only 70% will be volatilized. The heat value of methanol is lower but its evaporation heat is higher. Thus, when entering the cylinder, less fuel (vapor) will be vaporized, and will be stored in the cylinder in a liquid state. Thus, when methanol is used to more than a certain percent (about 15%) without other additives, the use of methanol requires that the engine be modified to overcome these problems.

Methanol and ethanol are polar substances of the same nature. They can be merged in non-polar gasoline very limitedly. Alcohol mainly contains water. (Methanol is 0.66% water, and ethanol is 8.69% water). The higher its water content is, the more likely the "phase separation" and "emulsification" are going to occur.

Different test reports of the this invention have proven the following functions of it:

A. Test Report on the Gasoline Quality

Mix Vol. 30% of the additive with Vol. 70% unleaded 92# gasoline and do the test according to the regulation of gasoline quality. See Table I for the result.

1. RVP decreases by 1.6 psi
2. RON increases over 100%
3. Sulfur decreases by 30% WT.
4. Existent Gum decreases by 80% mg/100 ml
5. Corrosion Test: non-corrosive
6. Same oxidation stability as that of gasoline
7. Distillation complies with the regulation of the gasoline quality

TABLE I

Description: Carbon Monoxide Eliminator
Method of Analysis: A. S. T. M.
Sample No.: ES-770115-116

| Property measured | Results: Additive | Additive + unleaded gasoline 70% | Specification for motor gasoline |
|---|---|---|---|
| Gravity API at 60° F. | 41.20 | 47.20 | |
| RVP psi | 6.20 | 8.40 | 10.00 |
| RON | over 100.00 | over 100.00 | 92.00 |
| Oxidation Stability min. | | 480.00 | 480.00 |
| Corrosion Test | Ia | Ia | No. 1 |
| Sulfur, WT % | 0.06 | 0.07 | 0.10 |
| Existent Gum, mg/100 ML | 1.20 | 0.80 | 4.00 |
| Distillation: | | | |
| I. B. P. °F. | 125.00 | 108.00 | |
| 10% | 130.00 | 123.00 | 165.00 |
| 50% | 134.00 | 136.00 | 268.00 |
| 90% | 142.00 | 344.00 | 360.00 |
| 95% | 159.00 | 308.00 | |
| E.P. | 215.00 | 421.00 | 437.00 |
| Rec. Vol. % | 98.50 | 98.50 | |
| Loss Vol. % | 1.00 | 1.00 | |

B. Fuel Consumption, Pollution and Horsepower Test One

A mixture of 30% by vol. of the additive and 70% by vol. unleaded gasoline are tested for:

(1) fuel consumption: fuel consumption is decreased by 1.5% Km/l.

(2) Pollution: a.) HC output is decreased by 9.5%. b.) CO output is decreased by 48.9%.

(3) Horsepower: a.) steady speed 60 Km/hr. 3rd gear, horsepower is increased by 3.07%. b.) steady speed 90 Km/hr. 4th gear, horsepower is increased by 4.19%.

None of the tested vehicles were equipped with catalytic converters, which shows that the results of fuel consumption, pollution and horsepower are better than that of pure gasoline. See Table II for details.

The tests were performed with the following equipment and conditions:

Car model: 1984 Ford Homerun 1.3
Engine number: SDNJCK 210149B-N
Spark timing: 10 B. T. D. C.
Idling speed: 750 rpm
Tire pressure: 2.0 Kg/cm$^2$
Reference car weight: 1065 kg
Engine type: front load, vertical alignment, 4 cylinders
Gear type: manual shift 4 gear
Test dates: Aug. 23–24, 1988
Fuel used:

1. leaded premium gasoline (8/23)
2. leaded premium gasoline with 30% fuel additive (8/24)

Environment temperature: 22.8° C. (8/23) 24.8° C. (8/24)
Relative humidity: 62.0%
Atmospheric pressure: 99.9 kPa (8/23) 100.3 kPa (8/24)

TABLE II

Test Reports on Fuel Consumption, Pollution, and Horsepower

Fuel Consumption Test Results

| Date | Fuel | Fuel Consumption | Steady speed fuel consumption, 90 Km/hr. | Average fuel consumption |
|---|---|---|---|---|
| Aug. 23 | leaded premium gasoline | 11.80 Km/L | 16.30 Km/L | 13.30 Km/L |
| Aug. 24 | leaded premium gasoline with 30% fuel additive | 12.00 Km/L | 16.70 Km/L | 13.50 Km/L |

Pollution Test Results

| Date | Fuel | HC | CO |
|---|---|---|---|
| Aug. 23 | leaded premium gasoline | 3.05 g/Km | 15.60 g/Km |
| Aug. 24 | leaded premium gasoline with 30% fuel additive | 2.76 g/Km | 3.07 g/Km |

Horsepower Test Result

| Date | Fuel | Steady speed 60 Km/hr. 3rd gear, maximum out put horsepower | Steady speed 60 Km/hr. 4th gear, maximum out put horsepower | Steady speed 90 Km/hr. 4th gear, maximum out put horsepower |
|---|---|---|---|---|
| Aug. 23 | leaded premium gasoline | 11.80 Km/L | 16.30 Km/L | 13.30 Km/L |
| Aug. 24 | leaded premium gasoline with 30% fuel additive | 12.00 Km/L | 16.70 Km/L | 13.50 Km/L |

Note: Testing was based on test methods CNS 7895D3077, CNS 11534D3173, and CNS 11496D3166.

C. Fuel Consumption and Pollution Test Two

Tests performed at Ta Ching Auto Manufacturer (Japanese Subaru series) in January 1991. The fuel mixture comprised 30% by vol. of my additive and 70% by vol. of unleaded gasoline. The test results are as follows:

a. CO emissions decreased by 79.79%
b. HC emissions decreased by 16.26%
c. $NO_x$ emissions decreased by 24.37%
d. $CO_2$ emissions decreased by 11.73%
e. Fuel consumption decreased by 21.29% (see table 3)

TABLE 3

EC Mode Emission

| | | | |
|---|---|---|---|
| Date: | Jan. 25–26, 1991 | Dry Temp: | 23.5° C. (1/25) |
| Model No.: | EC-MODE | | 26.8° C. (1/26) |
| Flame No.: | J-12M ECVT | Wet Temp: | 18.7° C. (1/25) |
| Engine No.: | CO 283 | | 21.2° C. (1/26) |
| Air pressure: | 705.1 mmHg (1/25) | Humidity: | 70.6% (1/25) |
| | 762.8 mmHg (1/26) | | 61.5% (1/26) |

EC MODE EMISSION TEST

| Date | Emission | CO g/Km | HC g/Km | NO x g/Km | $CO_2$ G/Km | F. E. Km/l |
|---|---|---|---|---|---|---|
| 1/25 | Gasoline | 12,340 | 2,091 | 2,642 | 207.21 | 10.18 |
| 1/26 | Gasoline with additive | 2,493 | 1,751 | 1,998 | 102.90 | 12.36 |

D. Fuel Consumption, Pollution and Horsepower Test Three

This test was performed in the central testing laboratory of Fujian Province using a fuel mixture comprising 30% by vol. of additive and with 70% by vol. gasoline. The fuel consumption test shows 13% decrease in fuel consumption under same road condition at 60 Km/hr. In the horsepower test, the utilization rate in fourth gear is 50% during an 8.5 Km climb, showing an increase of 33%. The emissions test shows that the content of CO and HC is lower (the gasoline for this test contains water) and that fuel mixture can help to reduce fuel consumption compared with pure gasoline. The dynamic property is improved and the pollution is reduced. See table 4 for details.

TABLE 4

1. Fuel consumption test
date: March 9, 1993 Vehicle tested: Mazda e 1800
distance: 60 Km Milage of vehicle: 135500 Km

| Vehicle tested | Fuel used | Running time (min.) | Fuel consumed |
|---|---|---|---|
| Mazda E1800(for 5 persons) | 90# pure gasoline | 76 | 6.69 |
| | 90# synthetic gasoline: (70% by vol. gasoline and 30% by vol. additive) | 83 | 5.81 |

2. Power test (continous climbing)
Date: March 11, 1993
Distance: 8.5 Km
Vehicle tested: Mazda E1800 (passengers limit: 5 persons)

| Test Item | Fuel used | 1st Gear | 2nd Gear | 3rd Gear | 4th Gear | Total |
|---|---|---|---|---|---|---|
| Time used for gear(s) | 90# gasoline | 10.0 | 18.0 | 697.8 | 144.0 | 859.0 |
| | 90# synthetic gasoline | 5.0 | 8.0 | 413.0 | 426.0 | 852.0 |
| Utilization rate of gear (%) | 90# gasoline | 1.2 | 2.1 | 80.0 | 16.8 | |
| | 90# synthetic gasoline | 0.6 | 0.9 | 48.5 | 50.0 | |
| Utilization frequency of gear | 90# gasoline | 1.0 | 2.0 | 10.0 | 8.0 | 21.0 |
| | 90# synthetic gasoline | 1.0 | 1.0 | 14.0 | 13.0 | 29.0 |
| Fuel consumption | 90# gasoline | | | 2.68 L | | |
| | 90# synthetic gasoline | | | 2.82 L | | |

3. Pollution test:
date: March 12, 1993 Vehicle tested: Mazda E 1800

| Fuel used | CO (%) | HC (%) | Remarks |
|---|---|---|---|
| 90# gasoline | >8.8% | 1600 | discharged gas contains water |
| 90# synthetic gasoline | >6.5% | 1500 | discharged gas contains water |

TABLE 5

In this test, the vehicle was started without warming the engine and the final steady index of CO was tested.

Date: August 31, 1993
Vehicle tested: ROVER MINI 1.31 (equipped with catalytic agent converter)

| | | CO | HC | Half life period in seconds | Final steady index of CO |
|---|---|---|---|---|---|
| without additive | starting without warming | 7.00 | | 5 15 25 35 | 0.60 |
| | starting after warming | 0.27 | 139 | | 0.27 |
| with additive | starting without warming | 1.93 | 218 | 5 30 60 | 0.50 |
| | starting after warming | 0.01 | 80 | | 0.01 |

F. Pollution Test Five

This is a research on the influence of different fuel additives on the discharged gas by the Environment Protection Agency of R.O.C. This test took one year to complete. Each product was tested at 800 rpm, 1500 rpm, and 2200 rpm. Each test took at least three hours to guarantee the stability of the result. The result of this one-year-long research by the Environment Protection Agency of R.O.C. shows that the additive can reduce the contents of $NO_x$, CO and HC and help to alleviate air pollution. K is the code of additive and the ratio of adding is 3:7 (i.e. 3 parts additive, 7 parts gasoline). The results of the test is shown in FIGS. 1–3.

Figure 1:
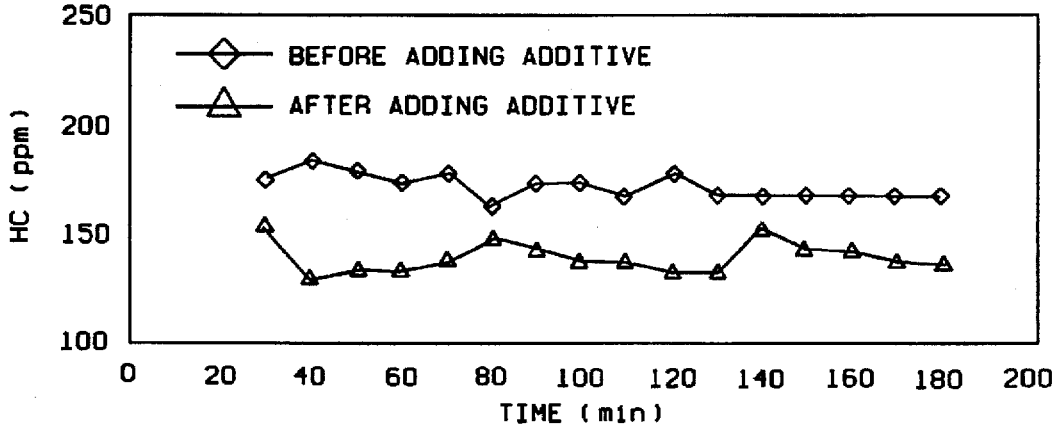

The results of $NO_x$, CO and HC emissions of an A14 injection engine using 95# unleaded gasoline with the additive at 800 rpm is shown in FIG. 1.

Figure 2B:
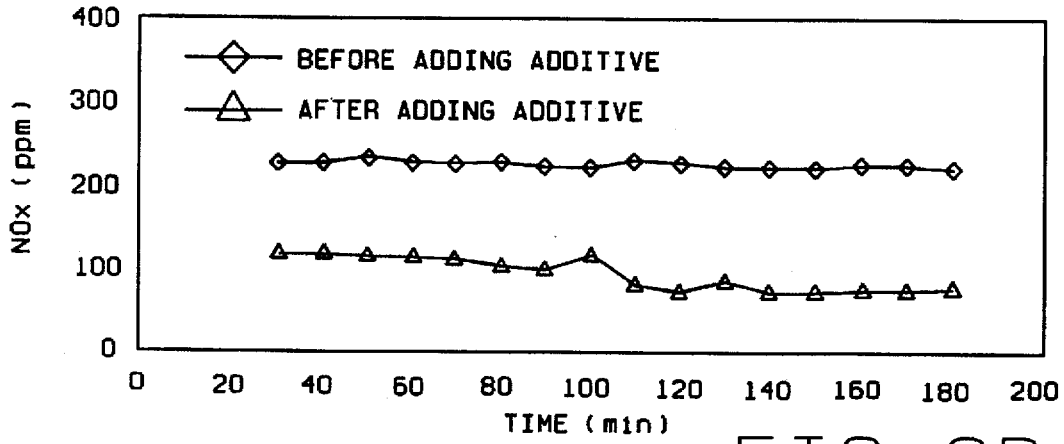
FIG. 2, 2A and 2B is a series of three graphs showing the results of $NO_x$, CO, and HC emissions of an A14 injection engine using 95# unleaded gasoline with the additive at 1500 rpm.
Figure 2A:
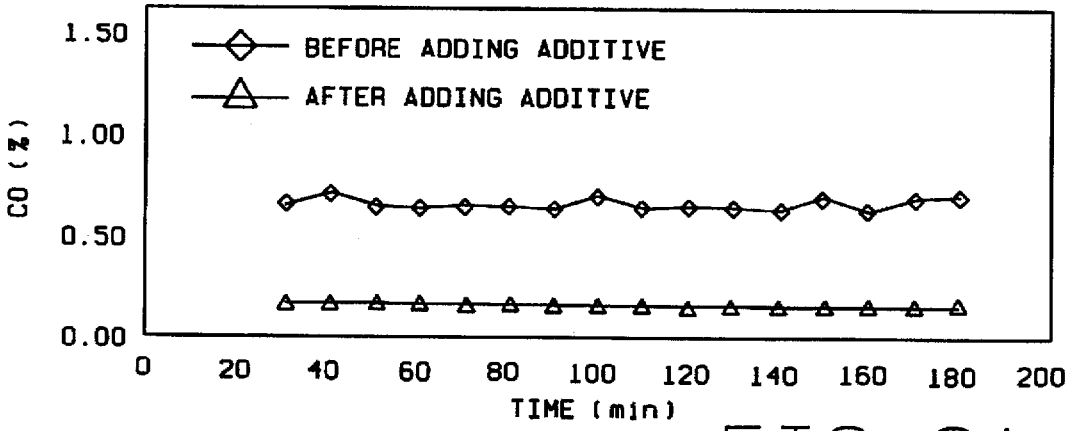
Figure 2:
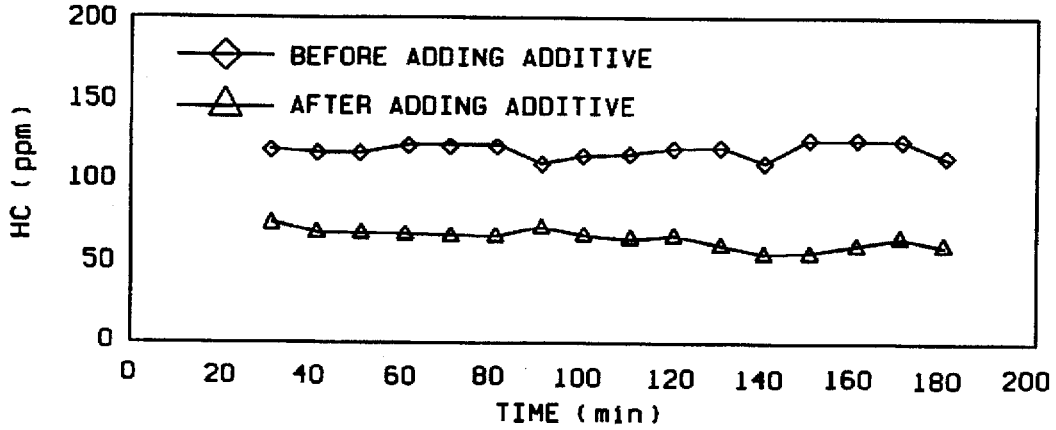

The results of $NO_x$, CO and HC emissions of the A14 injection engine using 95# unleaded gasoline with the additive at 1500 rpm is shown in FIG. 2.

Figure 3B:
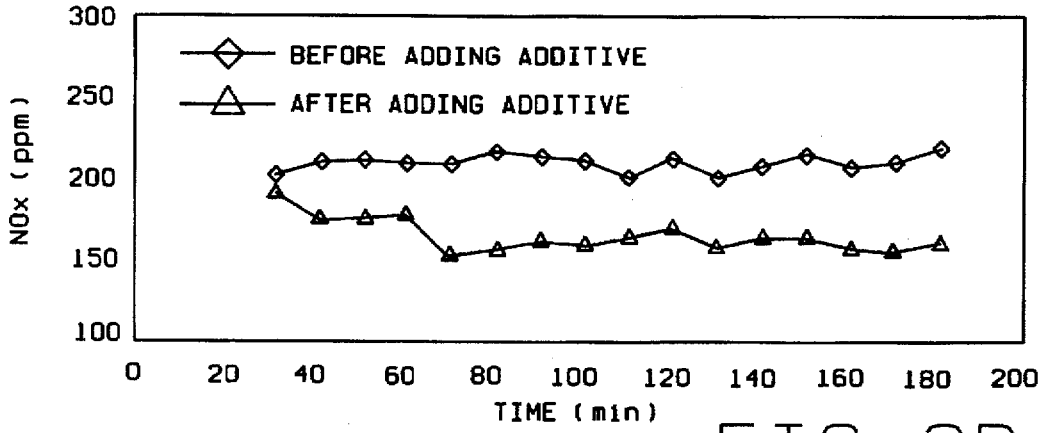
FIG. 3, 3A and 3B is a series of three graphs showing the results of $NO_x$, CO, and HC emissions of an A14 injection engine using 95# unleaded gasoline with the additive at 2200 rpm.
Figure 3A:
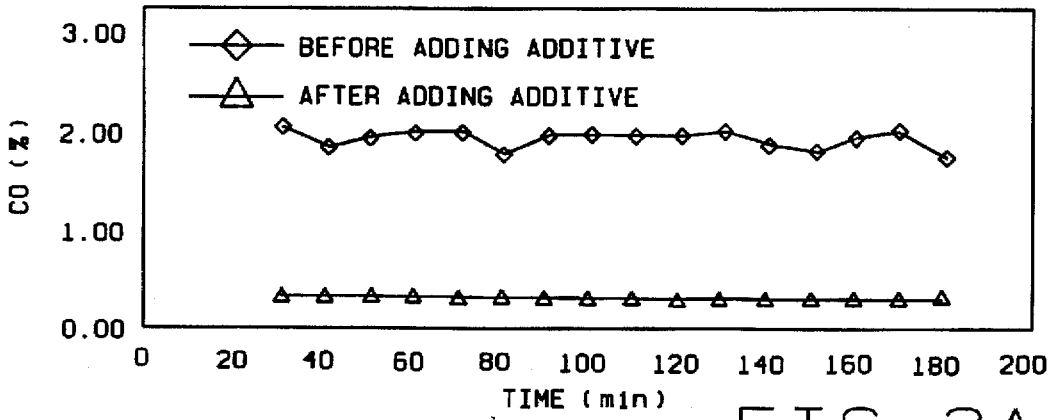
Figure 3:
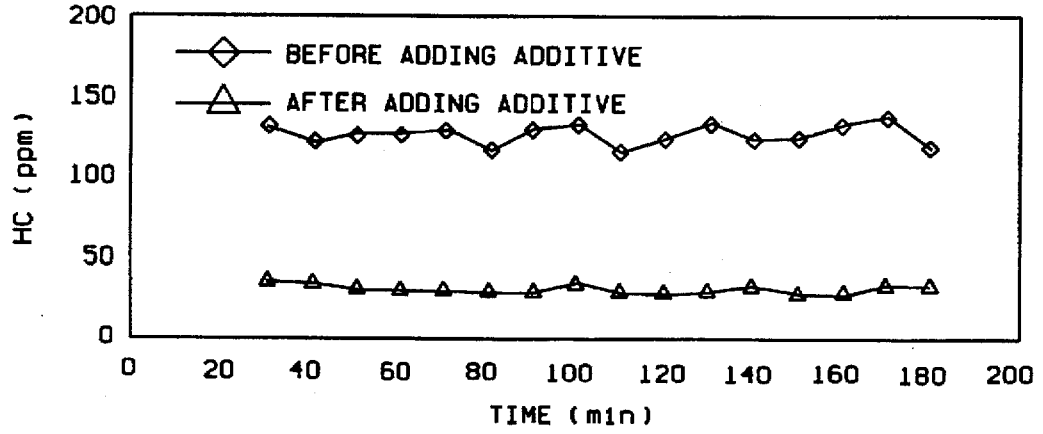

The results of $NO_x$, CO and HC emissions of the A 14 injection engine using 95# unleaded gasoline with the additive at 2200 rpm is shown in FIG. 3.

G. Pollution, Fuel Consumption and Horsepower, Test Six

This test was performed by Kuangyang Motorcycle Manufacturer with a fuel mixture comprising 20% by vol. of additive and 80% by vol. of 92# unleaded gasoline. The test was performed in January 1991 using a Kuangyang 100 c.c. (4-stroke) and 50 c.c. (2-stroke) engines. The results are shown below in Table 7.

TABLE 7

| Item | Sample | 92# Unleaded gasoline | | 92# Unleaded gasoline + additive | |
|---|---|---|---|---|---|
| | | Vehicle: 50 c. c. (2-stroke) | | | |
| Pollution index | CO g/Km | 15.700 | 8.700 | 2.780 | 2.760 |
| | HC g/Km | 4.428 | 4.060 | 3.260 | 3.110 |
| | $NO_X$ g/Km | 0.031 | 0.033 | 0.066 | 0.069 |
| Fuel consumption index | Urban area | 37.198 | 39.340 | 42.260 | 43.640 |
| | Steady speed | 45.990 | 51.440 | 57.390 | 67.270 |
| | Average | 40.270 | 43.130 | 47.250 | 50.770 |
| | | Vehicle: 100 c. c. (4-stroke) | | | |
| Pollution index | CO g/Km | 7.490 | 6.620 | 2.200 | 1.300 |
| | HC g/Km | 0.410 | 0.400 | 0.300 | 0.340 |
| | $NO_X$ g/Km | 0.193 | 0.209 | 0.231 | 0.314 |
| Fuel consumption index | Urban area | 49.170 | 50.550 | 51.880 | 53.630 |
| | Steady speed | 53.760 | 56.060 | 56.870 | 59.380 |
| | Average | 50.910 | 52.620 | 53.770 | 55.790 |

Figure 4A:
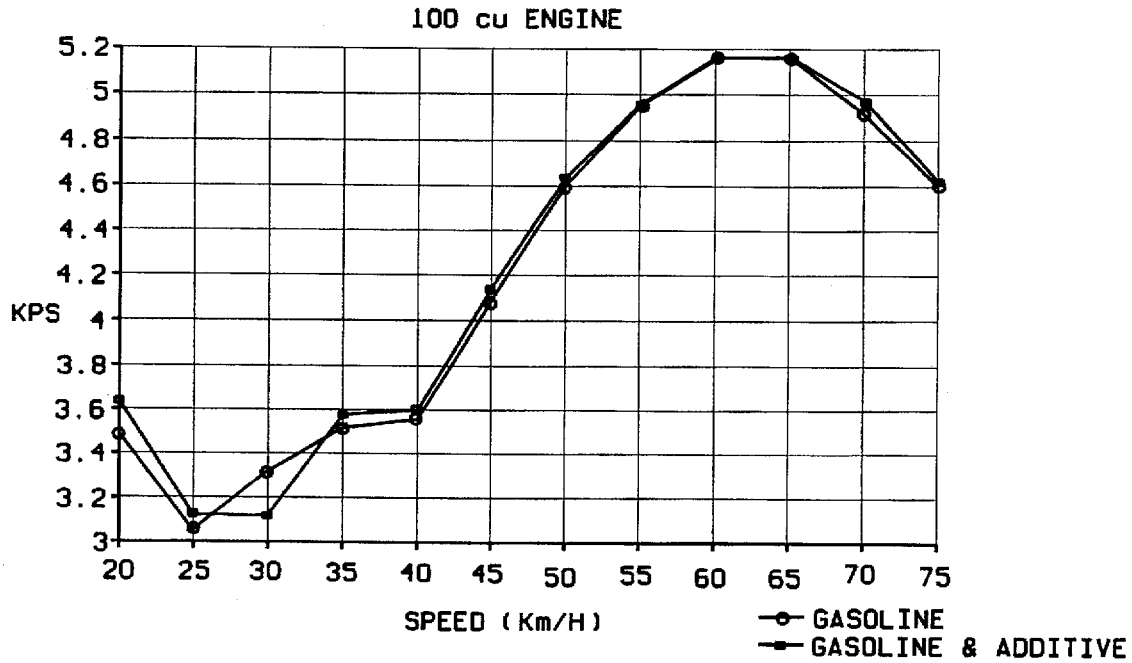
FIG. 4 and 4A is a series of two graphs comparing the power produced by the 50 cc and 100 cc motors using only 92# gasoline mixed with the additive (80/20).
Figure 4:
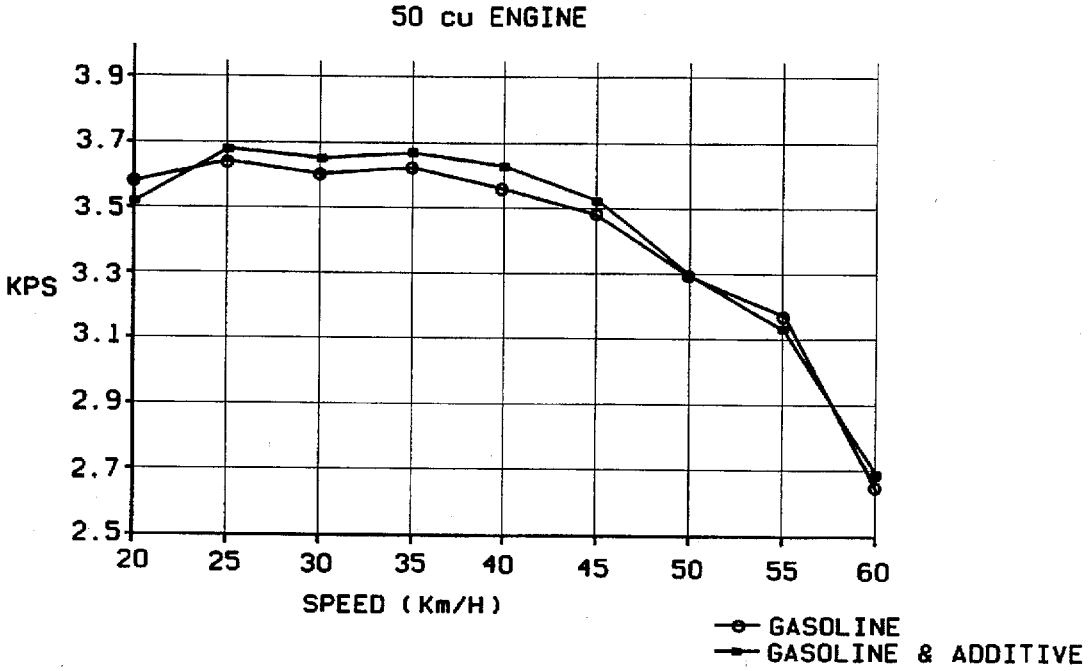

A comparison of the power produced by the 50 cc and 100cc motors using only 92# gasoline and using 92# gasoline mixed with the additive (80/20) is shown in FIG. 4.

H. Pollution, Test Seven

This test consists of a record of the regular automobile discharge check by the Environment Protection Agency of the R.O.C.

TABLE 8

Record of Regular Automobile Discharge Check by the Environment Protection Agency Date: 01/31/1994
Fuel: 92# gasoline

| | | | |
|---|---|---|---|
| Vehicle No. | DFH-396 | Checker | 001 |
| Model | 2-stroke | Number of equipment | A10 |
| Brand | 03 Kuangyang | Time of manufacture | July 1993 |
| Displacement | 50 | Code of station | A10 |

| Test item | Discharge standard | Test result | Judgment of computer |
|---|---|---|---|
| Carbon monoxide | 4.50 | 4.50 | merely pass |
| Hydrocarbon | 9000.00 | 7600.00 | merely pass |
| Carbon dioxide | | | |
| Seal of checker | pass (blue label) | merely pass (yellow label) | failed |

Record of Regular Automobile Discharge Check by the Environment Protection Agency Date: 01/02/1994
Fuel: 80% by vol. 92# gasoline, 20% by vol. additive.

| | | | |
|---|---|---|---|
| Vehicle No. | DFH-396 | Checker | 001 |
| Model | 2-stroke | Number of equipment | A10 |
| Brand | 03 Kuangyang | Time of manufacture | July 1993 |
| Displacement | 50 | Code of station | A10 |

| Test item | Discharge standard | Test result | Judgment of computer |
|---|---|---|---|
| Carbon monoxide | 4.50 | 1.10 | pass |
| Hydrocarbon | 9000.00 | 2150.00 | pass |
| Carbon dioxide | | | |
| Seal of checker | pass (blue label) | merely pass (yellow label) | failed |

Record of Regular Automobile Discharge Check by the Environment Protection Agency R.O.C.

Date: 03/04/1994
Fuel: 80% by vol. 92# gasoline, 20% by vol. additive.

| | | | |
|---|---|---|---|
| Vehicle No. | AFT-363 | Checker | 001 |
| Model | 4-stroke | Number of equipment | A01 |
| Brand | 02 Shanye | Time of manufacture | Feb. 1994 |
| Displacement | 125 | Code of station | A10 |

| Test item | Discharge standard | Test result | Judgment of computer |
|---|---|---|---|
| Carbon monoxide | 4.50 | 0.10 | pass |
| Hydrocarbon | 9000.00 | 130.00 | pass |
| Carbon dioxide | | | |
| Seal of checker | pass (blue label) | merely pass (yellow label) | failed |

Record of Regular Automobile Discharge Check by the Environment Protection Agency Date: 1994/05/30
Fuel: 80% by vol. 92# gasoline, 20% by vol. additive.

| | | | |
|---|---|---|---|
| Vehicle No. | AFT-363 | Checker | 001 |
| Model | 4-stroke | Number of equipment | A10 |
| Brand | 02 Shanye | Time of manufacture | Feb. 1994 |
| Displacement | 125 | Code of station | A10 |

TABLE 8-continued

| Test item | Discharge standard | Test result | Judgment of computer |
|---|---|---|---|
| Carbon monoxide | 4.50 | 0.00 | pass |
| Hydrocarbon | 9000.00 | 90.00 | pass |
| Carbon dioxide | | | |
| Seal of checker | pass (blue label) | merely pass (yellow label) | failed |

I. Test of Poisonous Substance

A sample of gasoline and a sample of additive were tested for the presence of various metallic impurities. The results, which are tabulated in Table 9, show that the additive contains none of the impurities for which it was tested. Ratio of additive: 30% CME, 70% gasoline

TABLE 9

| Substance tested | Content of Poisonous Substance (mg/l) | | | | | | | |
|---|---|---|---|---|---|---|---|---|
| | Pb | Mn | Cd | Cu | Ni | Zn | Fe | P |
| Test result of gasoline | none | none | none | none | none | none | 0.1 | none |
| Test result of mixture | none | none | none | none | none | none | none | none |

General Discussion of the Invention

This invention provides a new and non-polluting fuel that is primarily composed of alcohol. It also provides compound ingredients and procedures. The composition of this kind of fuel is from the existing alcohol group. The most important composition is methanol. In the course of synthesis, methanol production will not be required. Methanol may be obtained from the market. Methanol is the cheapest material among all chemicals. Using it as the primary composition of the new fuel will be economical. Also, this invention has a great contribution to the air pollution problem and energy saving.

The composition of this invention is about 40% to 70% alcohol, about 2.5% to 18% ketone and ether, and about 4%–20% aliphatic compounds and silicon compounds. It has 2 to 10 carbon atoms and 3 to 18 hydrogen and 3 to 16 oxygen atoms. Its molecular structure is as follows:

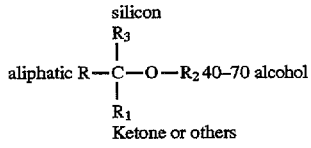

where R represents —$CH_3$, $C_3H_6$, $C_7H_8$, $C_6H_{10}$, and $C_{10}H_{18}$; $R_1$ is a carbonyl group; $R_2$ is H or —OH; and $R_3$ is an aliphatic or silicon compound.

The alcohol referred to herein is methanol, ethanol, hexyl alcohol, cyclohexanol, glycerin, ethanediol. The ketone group includes acetone, butanone, cyclohexanone, etc. The aliphatic compounds include the half-inorganic matters of mineral spirits, dihydric alcohol and tribasic alcohol. Silicones are —Si—O—Si—O—. The silicone compound is the most important substance in this invention. Its molecule formula is as follows:

1. $(CH_3)_3SiO[(CH_3)_2SiO]_x(CH_3)_3Si$, where x>2
2. $C_8H_{20}O_4Si$

The alcohol, ketone, ether, aliphatic compounds and silicon compounds are all parts of this invention. This invention is composed of 2 to 10 carbon atoms, 3 to 18 hydrogen atoms, 3 to 16 oxygen atoms, air and chain reaction. The product is formed through pressure reaction to generate energy chain. Through the affinity between the carbon atoms and oxygen atoms, and the carbon cycle, the original molecular structure and alcohol's polarity is changed through an isothermic reaction to form a closed chain. The molecule structure of the byproduct is as follows:

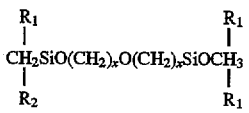

The molecule formula derived from the above structure should be the best compound. It is suitable for any kind of internal combustion engine without the need to modify the engine.

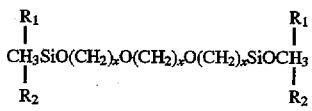

The process of conversion described above is an important part of this invention.

Aldehyde is known to be generated from the oxidization of alcohol. The oxidization of methanol will generate formaldehyde. The oxidization of ethanol will generate acetaldehyde. Using methanol as fuel will possibly generate formaldehyde. And formaldehyde is known to be cancer causing substance. Therefore, during the production of this invention, the formation of formaldehyde must be inhibited. The followings methods that can be applied to prevent the formation of formaldehyde when oxidizing methanol:

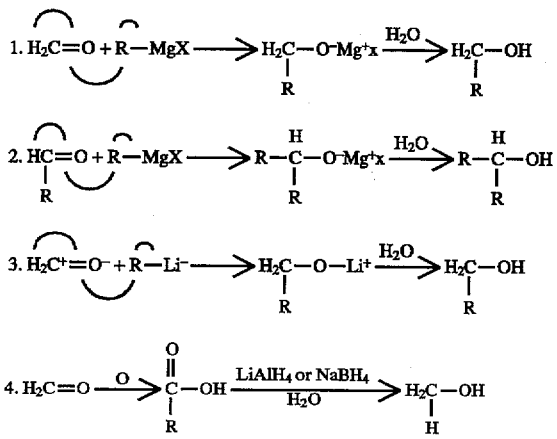

Alcohol is both alkali and acid, which is similar to water. When alcohol is oxidized, aldehyde is produced. This invention prevents the production of aldehyde according to the above theory. Aldehyde can be deoxidized to alcohol even if it has already been produced. Aldehyde may be oxidized easily to produce acid whereas ketone is not easy to oxidize. We can use the above method to deoxidize acid to alcohol even if aldehyde has been oxidized to acid.

The purpose of the above illustration of the oxidization of alcohol and aldehyde is to explain how to convert the aldehyde which is produced to alcohol. Such conversion is called oxidation-reduction. Different types and amount of alcohol are used during the production of this invention and we should choose from them according to the above method. Such process of oxidation-reduction is a very important characteristic part of this invention.

For most of the current researches on fuels incorporating alcohol, only 8% to 12% by vol. of alcohol is used. But for this invention, as much as 40% to 70% alcohol is used. In other words, one liter of this invention contains 400 c.c. to 700 c.c. methanol. This is an important characteristic of this invention.

Silicones compounds, which are semi-inorganic compounds, are highly heat-resistant. They can be added to internal combustion engine fuels. This unique method is an important characteristic of this invention.

This nature of invention is polar compound and its functions are:

a. It can be ionized and can conduct electric current.
b. It is chemically active.
c. It can be associated to form compound molecule.
d. It is of condensed structure.
e. It is of high electric inductivity.
f. It is of semi-inorganic compounds.
g. It shows tautomerism.

These are important characteristics of this invention.

This invention has been substituted for 30% of gasoline and it helps reduce fuel consumption by 20% or more when used as a gasoline additive. It can greatly reduce fuel consumption. This is an important characteristic of this invention.

This invention can improve the quality of gasoline and performance of engine, which is an important characteristic.

This invention can be used for any kind of internal combustion engine and no adjustment of engine is necessary. This is an important characteristic of this invention.

This invention can greatly reduce the amount of discharged wastes and improve air quality. The content of CO may be reduced by 79% and possibly as much as 90% or more. This is an important characteristic of this invention.

Test reports from The Ministry of Environment Protection of R.O.C., Chinese Petroleum Corp., The Industrial Research Institute and auto manufacturers prove that there are at least six basic characteristics of this invention:

1. It enhances the quality of gasoline.
2. It can be a substitute of gasoline and helps to save energy.
3. It helps to solve the problem of air pollution.
4. It can be mixed with gasoline and directly used for any kind of automobile and engine without any adjustment to the original engine structure being necessary.
5. Its nature is similar to that of gasoline and it has of good commercial and economic qualities.
6. It is very stable and has special functions. It can be adjusted to various situations.

The above six characteristics are confirmed by tests.

We may use the energy balance equation to illustrate the many functions of this invention:

Additive Fuel (F) = Enhance the quality of gasoline and horsepower Km/per Liter saving energy + exhaust emission ($CO + HC + NO_x + CO_2$) + heat Compared to the same quantity of gasoline, the fuel mixture of this invention can enhance horsepower, reduce exhaust emission and operating temperature when used in automobiles and engines for same mileage. In an other word, the most important function of this invention is to save energy and solve the problem of air pollution. Although all the tests have been limited to automobiles and engines, it may be used in a wider range of functions because it can be used as household fuel, industrial fuel and especially a clean fuel for airplanes.

I claim:

1. An alcohol based fuel additive which is added to gasoline for use in improving the performance of gasoline powered internal combustion engines without the need to modify standard gasoline engines, the fuel additive comprising about 20%–70.35% alcohol, about 2.5%–20% ketone and ether, about 0.03%–20% aliphatic and silicon compounds, about 5%–20% toluene, and about 4%–45% mineral spirits; wherein the alcohol is chosen from the group consisting essentially of methanol, ethanol, and combinations thereof; the ketone is chosen from the group consisting essentially of acetone, butanone, cyclohexanone, and combinations thereof; the aliphatic compound is chosen from the group consisting essentially of dihydric alcohol, tribasic alcohol, and combinations thereof; and the silicon compound is chosen from the group consisting essentially of silicon oil, ethyl silicate, and combinations thereof.

2. The fuel additive of claim 1 wherein the alcohol includes methanol and ethanol, the methanol comprising about 20%–70% of the additive and the ethanol comprising about 0.05–0.35% of the additive.

3. The fuel additive of claim 1 wherein the ketone comprises about 12–16% acetone, about 0.05% butanone, and about 2–6% cyclohexanone.

4. The fuel additive of claim 1 wherein the aliphatic compound includes about 0.2–0.4% dihydric alcohol, and about 0.3–0.6% tribasic alcohol.

5. The fuel additive of claim 1 wherein the silicon comprises about 0.03%–1% of the additive.

6. A fuel composition comprising about 30%–85% by volume gasoline and about 15%–70.35% by volume of an alcohol based fuel additive, the fuel additive comprising about 20%–70% alcohol, about 2.5%–20% ketone and ether, about 0.03%–20% aliphatic and silicon compounds, about 5%–20% toluene, and about 4%–45% mineral spirits; wherein the alcohol is chosen from the group consisting essentially of methanol, ethanol, and combinations thereof; the ketone is chosen from the group consisting essentially of acetone, butanone, cyclohexanone and combinations thereof; the aliphatic compound is chosen from the group consisting essentially of dihydric alcohol, tribasic alcohol, and combinations thereof; and the silicon compound is chosen from the group consisting essentially of silicon oil, ethyl silicate, and combinations thereof.

7. The fuel additive of claim 6 wherein the alcohol includes methanol and ethanol, the methanol comprising about 20%–70% of the additive and the ethanol comprising about 0.05–0.35% of the additive.

8. The fuel additive of claim 6 wherein the ketone comprises about 12–16% acetone, about 0.05% butanone, and about 2–6% cyclohexanone.

9. The fuel additive of claim 6 wherein the aliphatic compound includes about 0.2–0.4% dihydric alcohol, and about 0.3–0.6% tribasic alcohol.

10. The fuel additive of claim 6 wherein the silicon comprises about 0.03%–1% of the additive.

* * * * *